US007191898B1

(12) United States Patent
Williams

(10) Patent No.: US 7,191,898 B1
(45) Date of Patent: Mar. 20, 2007

(54) SAW BLADE CASE

(75) Inventor: Matthew Williams, Deerfield Beach, FL (US)

(73) Assignee: Union Rich USA, LLC, Pompano Beach, FL (US)

( * ) Notice: Subject to any disclaimer, the term of this patent is extended or adjusted under 35 U.S.C. 154(b) by 0 days.

(21) Appl. No.: 10/925,101

(22) Filed: Aug. 24, 2004

Related U.S. Application Data

(60) Provisional application No. 60/500,288, filed on Sep. 4, 2003.

(51) Int. Cl.
*B65D 85/02* (2006.01)

(52) U.S. Cl. ..... 206/303; 206/349

(58) Field of Classification Search ..... 206/303, 206/349, 372, 379, 311
See application file for complete search history.

(56) References Cited

U.S. PATENT DOCUMENTS 4,473,153 A * 9/1984 Colangelo ..... 206/312
4,762,225 A * 8/1988 Henkel ..... 206/308.1
4,784,263 A 11/1988 Stanley
4,811,998 A 3/1989 Rankin
4,838,709 A * 6/1989 Guerriero et al. ..... 206/308.3
4,888,798 A 12/1989 Earnest
4,896,771 A 1/1990 Edwards
4,924,378 A 5/1990 Hershey et al.
4,991,208 A 2/1991 Walker et al.
4,998,279 A 3/1991 Weiss
4,999,806 A 3/1991 Chernow et al.
5,010,571 A 4/1991 Katznelson
5,023,907 A 6/1991 Johnson et al.
5,027,398 A 6/1991 Miyoshi
5,046,090 A 9/1991 Walker et al.
5,046,092 A 9/1991 Walker et al.
5,047,928 A 9/1991 Wiedemer
5,054,064 A 10/1991 Walker et al.
5,058,162 A 10/1991 Santon et al.
5,065,429 A 11/1991 Lang
5,070,479 A 12/1991 Nakagawa
5,078,266 A * 1/1992 Rackley ..... 206/349
5,099,516 A 3/1992 Durkin et al.
5,103,476 A 4/1992 Waite et al.
5,109,413 A 4/1992 Comerford et al.
5,113,518 A 5/1992 Durst, Jr. et al.
5,117,458 A 5/1992 Takaragi et al.
5,119,319 A 6/1992 Tanenbaum
5,126,728 A 6/1992 Hall
5,166,886 A 11/1992 Molnar et al.
5,222,134 A 6/1993 Waite et al.
5,235,642 A 8/1993 Wobber et al.
5,257,373 A 10/1993 Kurihara et al.
5,260,999 A 11/1993 Wyman
5,697,498 A 12/1997 Weisburn et al.
5,720,384 A * 2/1998 Wu-Chen ..... 206/311
5,826,717 A * 10/1998 Eskandry ..... 206/311
6,106,015 A * 8/2000 Udwin et al. ..... 206/311

(Continued)

*Primary Examiner*—Luan K. Bui
(74) *Attorney, Agent, or Firm*—Myers & Kaplan, LLC; Joel D. Myers, Esq.

(57) ABSTRACT

A case for holding multiple saw blades includes an upper shell and a lower shell which collectively enclose a volume, with multiple pockets contained within the volume. Each of the pockets is adapted for holding a saw blade such that the saw blade is protected from contact with saw blades in adjacent pockets, and such that each saw blade may be individually accessed.

8 Claims, 3 Drawing Sheets

U.S. PATENT DOCUMENTS 6,164,447 A 12/2000 Svetlik
6,230,887 B1 5/2001 Snider
6,241,086 B1 * 6/2001 Bergh et al. ..... 206/312
6,401,922 B1 6/2002 Svetlik
6,446,797 B1 * 9/2002 Shiga ..... 206/303
6,758,336 B2 * 7/2004 Kohana ..... 206/308.1

* cited by examiner

SAW BLADE CASE

CROSS REFERENCES TO RELATED APPLICATIONS

This application claims priority from U.S. Provisional Application Ser. No. 60/500,288 filed Sep. 4, 2003, the entire disclosure of which is incorporated herein by this reference.

FIELD OF THE INVENTION

The present invention relates to cases for holding tools, and, more particularly, to cases for holding saw blades and related and/or similarly constructed tools.

BACKGROUND OF THE INVENTION

Cases for holding tools serve a variety of functions. For example, tool cases provide a location for the tools to be stored and easily located when they are needed. Tool cases also serve to protect the tools from damage while they are being stored.

Cases for various tools have been designed, including cases specifically designed to hold saw blades; however, many of these saw blade cases are cumbersome to use, have a limited capacity, or have other associated problems. For example, some cases hold a stack of saw blades on a threaded spindle, making it difficult for a user to remove a desired saw blade if it does not happen near the top of the stack. For another example, some cases do not sufficiently confine the saw blades, permitting the edges of the blades to rub against one another or against any tools which may be stored with the blades. This contact between the blades often dulls the cutting surfaces, thus requiring more frequent sharpening of the cutting surfaces. Frequent sharpening can become quite costly, particularly when the blades are tipped with carbide, which is brittle and therefore susceptible to cracking.

Accordingly, there remains a need in the art for a device which satisfactorily addresses the above-identified problems.

SUMMARY OF THE INVENTION

The present invention meets the above-identified needs, and others, by providing a saw blade case for holding, organizing, and protecting a plurality of blades, while permitting each blade to be readily accessed.

An exemplary embodiment of the saw blade case of the present invention contains multiple individual pockets for receiving a saw blade. The case has a upper shell and a lower shell, which are hinged together at an interface, much like an oyster shell. Additionally, the pockets are hinged to the case on an interior side of the interface allowing the pockets to be turned like the pages of a book.

Each pocket of the embodiment includes an upper panel and a lower panel, which are joined to one another along a portion of their respective perimeters, such that an opening remains for interposing the saw blade between the panels. Each pocket additionally includes a retaining mechanism, which may be used to close the opening between the panels, further securing the saw blade within the pocket. Once the saw blades have been placed in the pockets, the case may be closed by selectively joining the shells to one another using, for example, a zipper.

DETAILED DESCRIPTION OF THE INVENTION

The present invention is a saw blade case for holding, organizing, and protecting a plurality of blades, while permitting each blade to be readily accessed.

Figure 1:
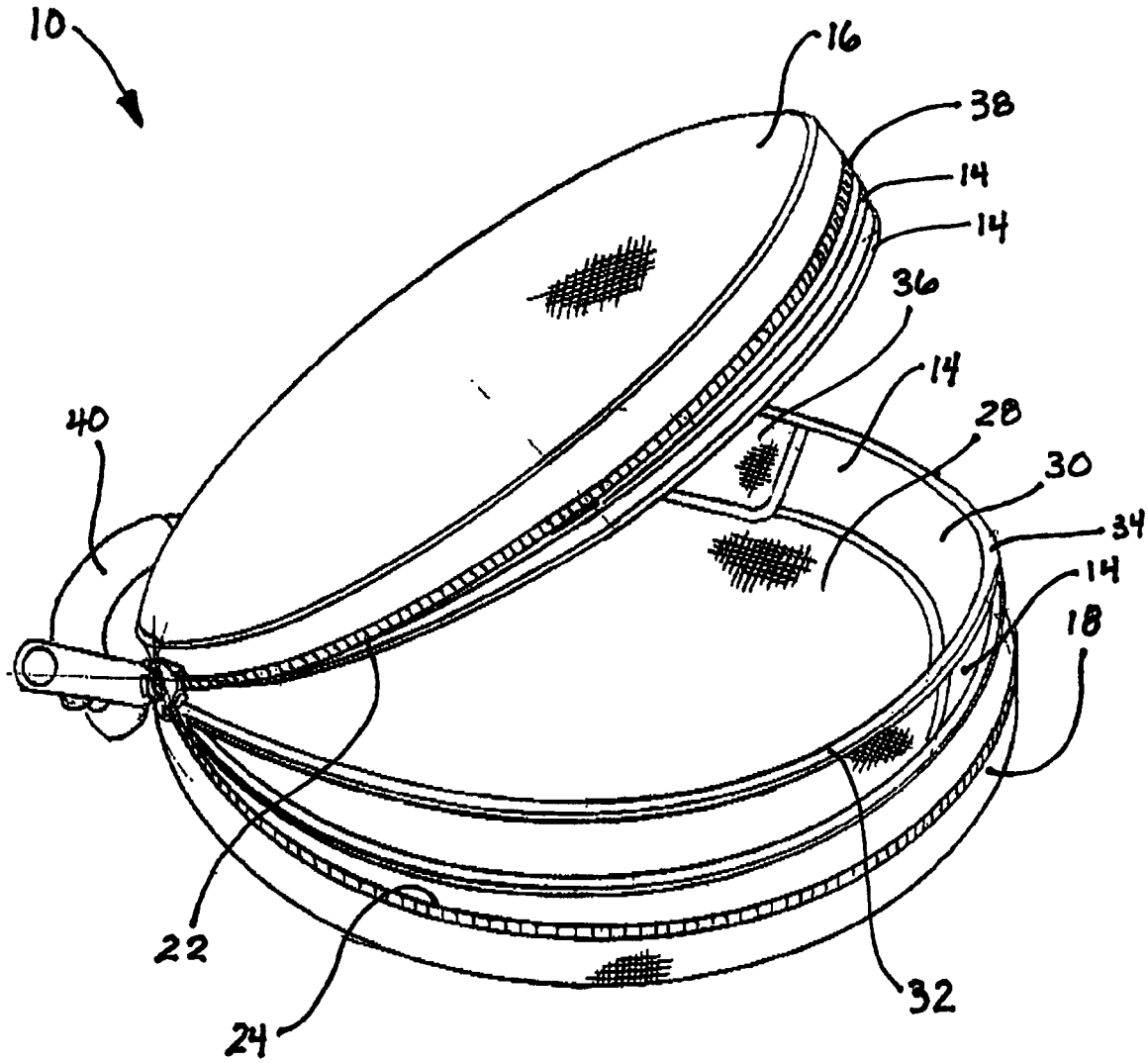
FIG. 1 is a perspective view of an exemplary saw blade case made in accordance with the present invention.
Figure 2:
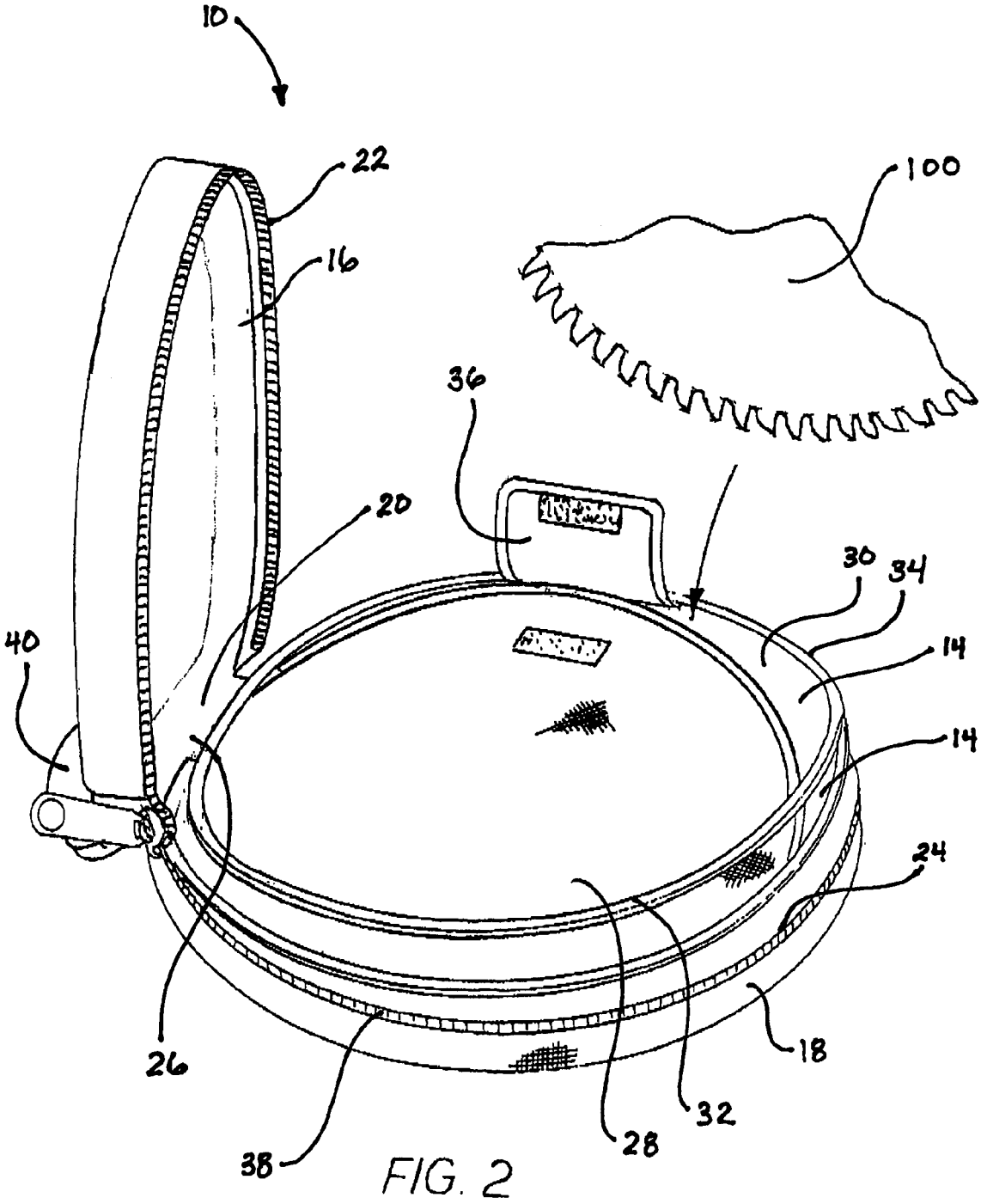
FIG. 2 is a perspective view of the exemplary saw blade case of FIG. 1, showing a pocket ready to receive a saw blade.

With reference to FIGS. 1 and 2, an exemplary embodiment of a saw blade case 10 made in accordance with the present invention contains multiple individual pockets 14, each pocket 14 being adapted for receiving a saw blade 100. The case 10 can be constructed from a durable fabric material, such as nylon, or a variety of other materials, including leather or a molded polymer. When the case 10 is constructed from a fabric material, it may also include reinforcing panels, covered by the fabric, which are constructed from a generally rigid material, such as a polymer, paperboard, cardboard, or metal.

The case 10 includes an upper shell 16, and a lower shell 18, the upper and lower shells 16, 18, each having a peripheral edge 22, 24 and collectively enclosing a volume. The upper shell 16 and the lower shell 18 may be integral with one another or otherwise hinged together at an interface 20 along a portion of the peripheral edges 22, 24 of the respective shells 16, 18, much like an oyster shell. Additionally, the pockets 14 are hinged to the case 10 on an interior side 26 of the interface 20 allowing the pockets 14 to be turned like the pages of a book. In this regard, it is contemplated that the shells 16, 18 have a size and shape that allows the pockets 14 to fit snuggly within the volume defined by the shells 16, 18.

Referring specifically to FIG. 2, each pocket 14 includes an upper panel 28 and a lower panel 30. The panels 28, 30 each have a perimeter 32, 34 and are joined to one another along a substantial portion of their respective perimeters 32, 34, such that an opening remains for interposing the saw blade 100 between the panels 28, 30. In this exemplary embodiment, each pocket 14 additionally includes a retaining mechanism 36, which may be used to close the opening between the panels 28, 30, further securing the saw blade 100 within the pocket 14. In this exemplary embodiment, the retaining mechanism 36 is integral with or otherwise joined to the lower panel 30 at one end and may be removably secured to the upper panel 28 at another end using common hook-and-loop fasteners. Of course, although a single pocket 14 is described above, it is understood that each pocket 14 of the case 10 has a similar construction. Furthermore, notwithstanding the number of pockets 14 that are visible in the Figures, it is contemplated that any number of pockets could be provided without departing from the spirit and scope of the invention.

Once the blades 100 have been placed in the pockets 14, the case 10 may be closed. Specifically, the shells 16, 18 of the case 10 may be selectively joined to one another such that their peripheral edges 22, 24 meet, thereby closing the case 10. In this exemplary embodiment, a zipper 38 is provided for connecting the shells 16, 18 along their peripheral edges 22, 24. Of course, the shells 16, 18 may be joined in a variety of manners, for example, using hook-and-loop fasteners, snaps, or elastic cording, without departing from the spirit and scope of the present invention.

Although a pocket 14 generally should be substantially the same size and shape as the saw blade 100, they may take on any size or shape so long as they are capable of receiving and retaining the saw blade 100.

Figure 3:
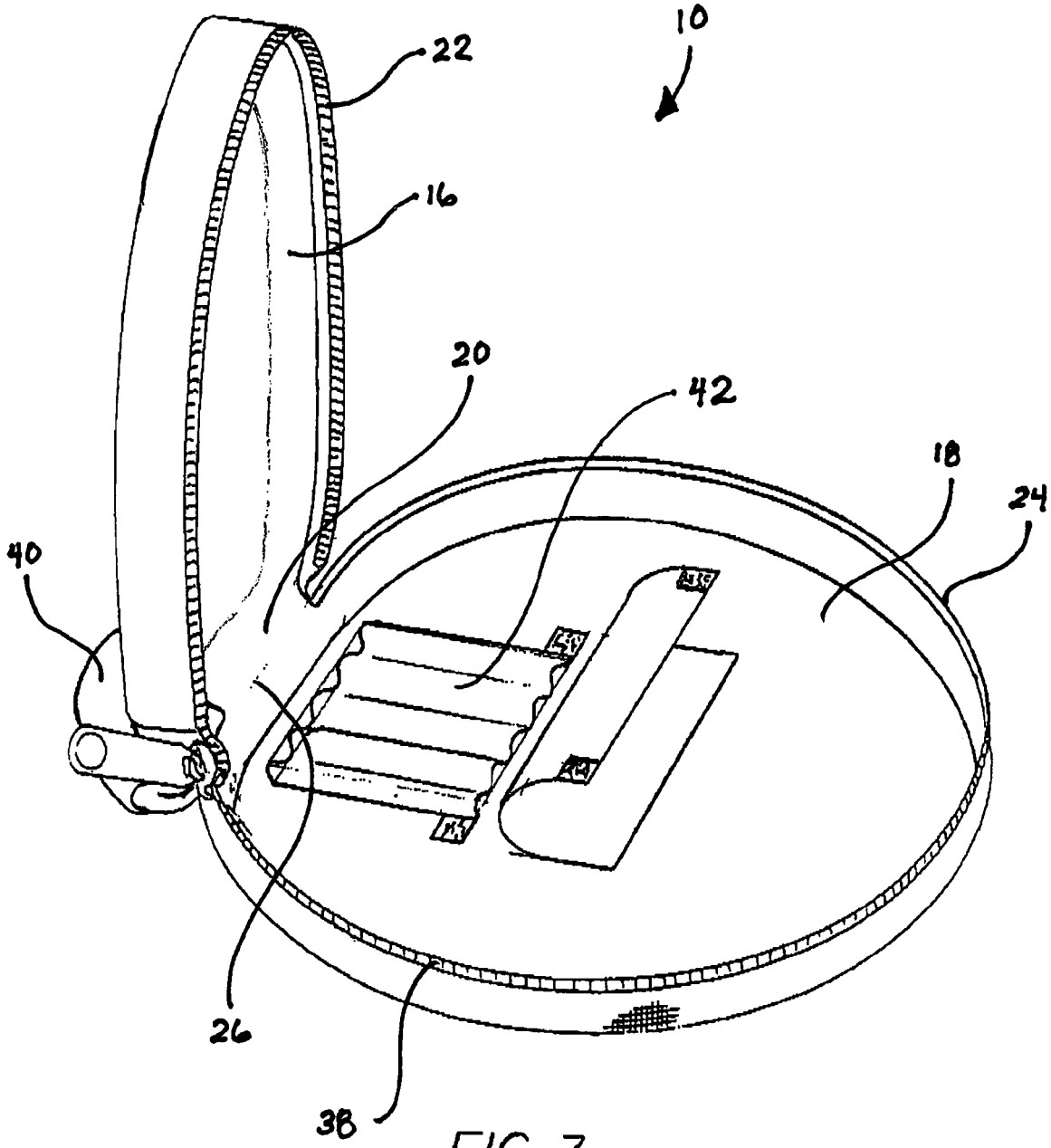
FIG. 3 is a perspective view of the exemplary saw blade case of FIG. 1, with the pockets removed to show an interior compartment for storing and organizing drill bits.

In this exemplary embodiment, the case 10 additionally includes a handle 40, secured to the case 10 and allowing it to be more easily carried. The handle 40 is secured to the case 10 along an exterior side (not shown) of the interface 20. With reference to FIG. 3, the case 10 may also include an interior compartment 42 for storing additional tools. For example, the compartment 42 shown is adapted for receiving and retaining multiple drill bits.

It will be obvious to those skilled in the art that further modifications may be made to the embodiments described herein without departing from the spirit and scope of the present invention.

What is claimed is:

1. A case for holding multiple saw blades, comprising:

an upper shell and a lower shell, which collectively define a volume;

at least two pockets contained within the volume, each pocket adapted for receiving and holding a saw blade and protecting the saw blade from contact with saw blades that may be contained in adjacent pockets, while still allowing individual access to each pocket;

a retaining mechanism for closing an opening defined by each pocket for receiving a saw blade, wherein said retaining mechanism is integral with or otherwise joined to a first portion of each pocket and is capable of being removably secured to a second portion of each pocket; and a compartment secured to an interior surface of one of the shells of the case, including sub-compartments that are each substantially the same size and shape as a drill bit.

2. The case for holding multiple saw blades of claim 1, wherein the pockets are hinged to an interior portion of the case.

3. The case for holding multiple saw blades of claim 1, wherein the upper shell and the lower shell are hinged together.

4. The case for holding multiple saw blades of claim 3, and further comprising a joining mechanism, for connecting a peripheral edge of the upper shell with a peripheral edge of the lower shell, thereby closing the case.

5. The case for holding multiple saw blades of claim 4, wherein said joining mechanism is a zipper.

6. The case for holding multiple saw blades of claim 5, and further comprising a handle.

7. A case for holding multiple saw blades comprising:

an upper shell and a lower shell, which collectively define a volume;

at least two pockets contained within the volume, each pocket adapted for receiving and holding a saw blade and protecting the saw blade from contact with saw blades that may be contained in adjacent pockets, while still allowing individual access to each pocket;

a retaining mechanism for closing an opening defined by each pocket for receiving a saw blade, wherein said retaining mechanism is integral with or otherwise joined to a first portion of each pocket and is capable of being removably secured to a second portion of each pocket; and an interior compartment for holding tools, wherein the interior compartment includes sub-compartments that are each substantially the same size and shape as a drill bit.

8. A case for holding multiple saw blades, comprising:

an upper shell and a lower shell, which collectively define a volume;

at least two pockets contained within the volume, each pocket adapted for receiving and holding a saw blade and protecting the saw blade from contact with saw blades that may be contained in adjacent pockets, while still allowing individual access to each pocket;

a retaining mechanism for closing an opening defined by each pocket for receiving a saw blade, wherein said retaining mechanism is integral with or otherwise joined to a first portion of each pocket and is capable of being removably secured to a second portion of each pocket; and an interior compartment, including sub-compartments for holding tools.

* * * * *